US007007950B2

(12) United States Patent
Im

(10) Patent No.: US 7,007,950 B2
(45) Date of Patent: Mar. 7, 2006

(54) PAPER FEEDING APPARATUS FOR IMAGE FORMING APPARATUS AND CONTROLLING METHOD THEREOF

(75) Inventor: Dae-hyeok Im, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 10/619,603

(22) Filed: Jul. 16, 2003

(65) Prior Publication Data

US 2004/0017036 A1 Jan. 29, 2004

(30) Foreign Application Priority Data

Jul. 25, 2002 (KR) ..... 2002-43761

(51) Int. Cl.
*B65H 7/02* (2006.01)

(52) U.S. Cl. ..... 271/258.01; 271/259; 250/559.4

(58) Field of Classification Search ..... 271/10.02, 271/10.03, 110, 258.01, 259; 250/559.01, 250/559.29, 559.36, 559.39, 559.4
See application file for complete search history.

(56) References Cited

U.S. PATENT DOCUMENTS 4,569,717 A * 2/1986 Ohgami et al. ..... 216/85
4,578,770 A * 3/1986 Mitani ..... 250/559.2
6,586,759 B1 * 7/2003 Mayo et al. ..... 250/559.4
6,590,223 B1 * 7/2003 Chelvayohan ..... 250/559.4
6,794,669 B1 * 9/2004 Chelvayohan et al. ... 250/559.4
2004/0017416 A1 * 1/2004 Chelvayohan et al. ..... 347/19

* cited by examiner

*Primary Examiner*—David H. Bollinger
(74) *Attorney, Agent, or Firm*—Staas & Halsey LLP

(57) ABSTRACT

An apparatus and method feed paper in an image forming apparatus. The paper feeding apparatus in an image forming apparatus includes: a pick-up roller rotated by a pick-up motor, to pick up a paper; a driving roller and a feeding roller rotated respectively by a line feeding motor, to transfer a paper; a media sensor having: a light emitting unit positioned on a paper transferring path, to emit light onto a paper moved forward by the pick-up roller; at least one light receiving unit installed at a predetermined angle with respect to a paper, to receive light reflected from a paper, the paper being illuminated by the light from the light emitting unit and moved forward along the paper transferring path; a pick-up switch unit to output a paper entrance determination signal by comparing an output signal from the light receiving unit with a predetermined reference signal; and a controller to determine whether a paper is provided on a basis of the paper entrance determination signal input from the pick-up switch unit, and to determine the paper type using a signal input from the light receiving unit. As a result, not only a paper type but also whether a paper is picked up is detected through the media sensor, so that the mechanical construction is improved and manufacturing costs are reduced.

9 Claims, 6 Drawing Sheets

PAPER FEEDING APPARATUS FOR IMAGE FORMING APPARATUS AND CONTROLLING METHOD THEREOF

CROSS REFERENCE TO RELATED APPLICATIONS

This application claims the priority of Korean Patent Application No. 2002-43761, filed Jul. 25, 2002, in the Korean Intellectual Property Office, the disclosure of which is incorporated herein in its entirety by reference.

BACKGROUND OF THE INVENTION

1. Field of the Invention

The present invention relates to an image forming apparatus and more particularly to a paper feeding apparatus for an image forming apparatus capable of detecting both a paper type and paper entrance into a paper transferring path by using a media sensor, and a controlling method thereof.

2. Background of the Related Art

Generally, an image forming apparatus such as laser printer, facsimile, copying machine or multifunction machine performs the printing job by transferring an image corresponding to a data signal input from inside/outside through a photoconductive drum, onto a printing media, i.e., a printing paper provided by a paper feeding system.

For such an image forming apparatus, various types of media, such as ordinary paper, transparent paper, high glossy paper and fabric can be used. Since such a variety of printing media require different printing conditions, such as heating temperature and speed, there is an image forming apparatus having a media sensor for detecting a printing media type so that appropriate printing can be performed automatically according to the printing media type.

A paper feeding apparatus for the image forming apparatus having such a media sensor of a related art is described below with reference to FIG. 1 through FIG. 3.

FIG. 1 is a drawing, schematically illustrating the paper feeding apparatus having a conventional media sensor. As shown in FIG. 1, the paper feeding apparatus includes a pick-up roller 11 for picking up a paper to be printed, a driving roller 12 for transferring the picked-up paper, a feeding roller 13 for providing a paper so that the printing job is performed, a pick-up sensor 21 for detecting whether a paper is picked up, and a media sensor 22 for detecting a paper type.

The pick-up roller 11, being rotated by a pick-up motor (not shown), picks up a paper to be printed and transfers the paper onto a paper transferring path. The paper transferring path is denoted by a bold solid line in FIG. 1. The driving roller 12, being rotated by a line feeding motor (not shown), transfers the paper transferred by the pick-up roller 11 to a predetermined position. The feeding roller 13 is rotated by a line feeding motor (not shown) and transfers the paper to a predetermined position so that the paper can be printed at a printing head (not shown). The pick-up sensor 21 is installed at a predetermined position on the paper transferring path to detect whether a paper is picked up by rotation of the pick-up roller 11 and enters the paper transferring path, and to apply a resultant signal to a controller for controlling the paper feeding apparatus.

FIG. 2 is a circuit diagram illustrating the circuit construction of such a pick-up sensor 21. The pick-up sensor 21 includes a photo interrupter and is configured such that light is blocked by a paper entering the paper transferring path, and the pick-up sensor 21 provides a paper entrance determination signal to a controller 20. When the paper entrance determination signal is provided from the pick-up sensor 21, the controller 20 judges that a paper is picked up and enters the paper transferring path.

At the time that the paper is aligned before being provided to the printing head for printing, the paper is near the media sensor 22 and accordingly, the media sensor 22 is turned on. For a media sensing system for judging a paper type, a combination of light emitting/receiving sensors is used.

FIG. 3 illustrates a driving circuit that drives the media sensor 22. A light receiving unit of the media sensor 22 includes two phototransistors 25*a* and 25*b* installed at different angles respectively with respect to the surface of a paper. A light emitting unit includes a resistor 26*a* connected in series between a power voltage (of 5 V for example) and a ground voltage, and a LED (Light Emitting Diode) 26*b*. The LED 26*b* projects light onto a paper passing over the drive roller 12.

Light from the LED 26*b* is reflected from the paper and incident on the phototransistors 25*a* and 25*b* installed at different angles with respect to the paper. Since the phototransistors 25*a* and 25*b* are at different angles with respect to the paper, incident light reflected from a paper is in different quantities, and therefore, different outputs are input from the phototransistors 25*a* and 25*b* to the controller 20. The controller 20 calculates a ratio of the outputs from the phototransistors 25*a* and 25*b*, analyzes the reflective rate of the paper and accordingly determines the paper type. A database having information regarding paper types in relation to ratios of outputs from the phototransistors 25*a* and 25*b* is set in advance experimentally.

As described, the conventional paper feeding apparatus requires the pick-up sensor for sensing whether a paper is picked up and enters the paper transferring path as well as the media sensor for sensing a paper type, respectively. Therefore, mechanical construction for installing each sensor on the paper transferring path is complex, and costs for parts are increased due to the use of additional parts.

SUMMARY OF THE INVENTION

An aspect of the invention is to solve at least the above problems and/or disadvantages and to provide at least the advantages described hereinafter.

Accordingly, one aspect of the present invention is to solve the foregoing problems by providing an apparatus for feeding a paper in an image forming apparatus, wherein the apparatus is capable of detecting not only the paper type, but also the paper entrance to the paper transferring path by using a media sensor, and a controlling method thereof.

The foregoing and/or other aspects and advantages are realized by providing an apparatus to feed a paper in an image forming apparatus including: a pick-up roller rotated by a pick-up motor, to pick up a paper; a driving roller and a feeding roller rotated respectively by a line feeding motor, to transfer a paper; a media sensor having a light emitting unit positioned on a paper transferring path, to emit light onto a paper moved forward by the pick-up roller; at least one light receiving unit installed at a predetermined angle with respect to a paper, to receive light reflected from a paper, illuminated by the light emitting unit and moved forward along the paper transferring path; a pick-up switch unit to output a paper entrance determination signal by comparing an output signal from the light receiving unit with a set reference signal; and a controller to determine whether a paper is provided on a basis of the paper entrance determination signal input from the pick-up switch unit, and to determine the paper type using a signal input from the light receiving unit.

Additional aspects and/or advantages of the invention will be set forth in part in the description which follows and, in part, will be obvious from the description, or may be learned by practice of the invention.

The light receiving unit of the media sensor may include two phototransistors installed at a different angle with respect to a paper, wherein light illuminated by the light emitting unit is reflected from a paper and then is provided to the light receiving unit installed at a different angle. Also, the pick-up switch unit includes a comparator branching off at an output side of the phototransistor not vertically installed with respect to a paper, to output the paper entrance determination signal by comparing a signal provided from the phototransistor with a predetermined reference signal.

According to the present invention, a method is used to feed a paper in an image forming apparatus, and utilizes an apparatus comprising: a pick-up roller rotated by a pick-up motor, to pick up a paper; a driving roller and a feeding roller rotated respectively by a line feeding motor, to transfer a paper; a media sensor having a light emitting unit, a light receiving unit, and a pick-up switch unit, to sense a presence of a paper. The method: includes: if a printing command is received, driving the pick-up motor, and simultaneously turning on the light emitting unit of the media sensor; if the light receiving unit is turned on, and a paper entrance determination signal is output from the pick-up switch unit, determining that a paper is provided, turning off the light emitting unit; if the pick-up roller is rotated, and a paper is transferred up to the driving roller, aligning a paper by driving the line feeding motor backward; if the paper is aligned, detecting a paper type by turning on the media sensor; if detection of a paper type is completed, feeding a paper by rotating the feeding roller forward, and performing printing depending on-the detected paper type.

Here, detecting a paper type is generally configured such that turning on the light emitting unit, computing a ratio of output values provided from the two transistors, and determining a paper type among the set paper types depending on the ratio of the output values are sequentially performed.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE EMBODIMENT

The following is a description of a paper feeding apparatus in an image forming apparatus according to an embodiment of the present invention with reference to the accompanying drawings.

Figure 1:
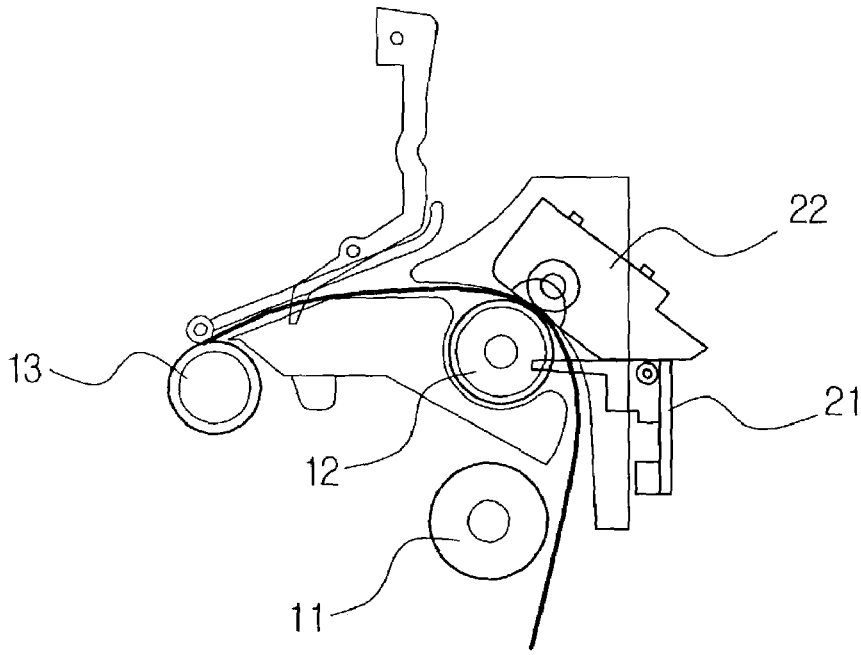
FIG. 1 (PRIOR ART)
FIG. 1 is a schematic view illustrating a conventional paper feeding apparatus.
Figure 2:
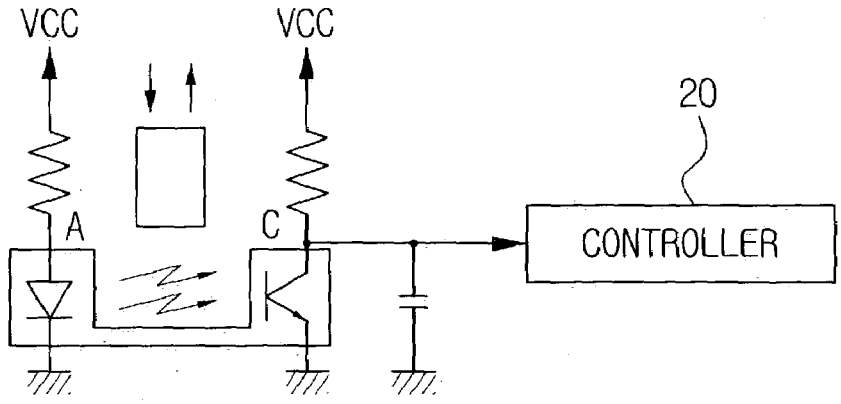
FIG. 2 (PRIOR ART)
FIG. 2 is a circuit diagram illustrating a pick-up sensor of the conventional paper feeding apparatus of FIG. 1.
Figure 3:
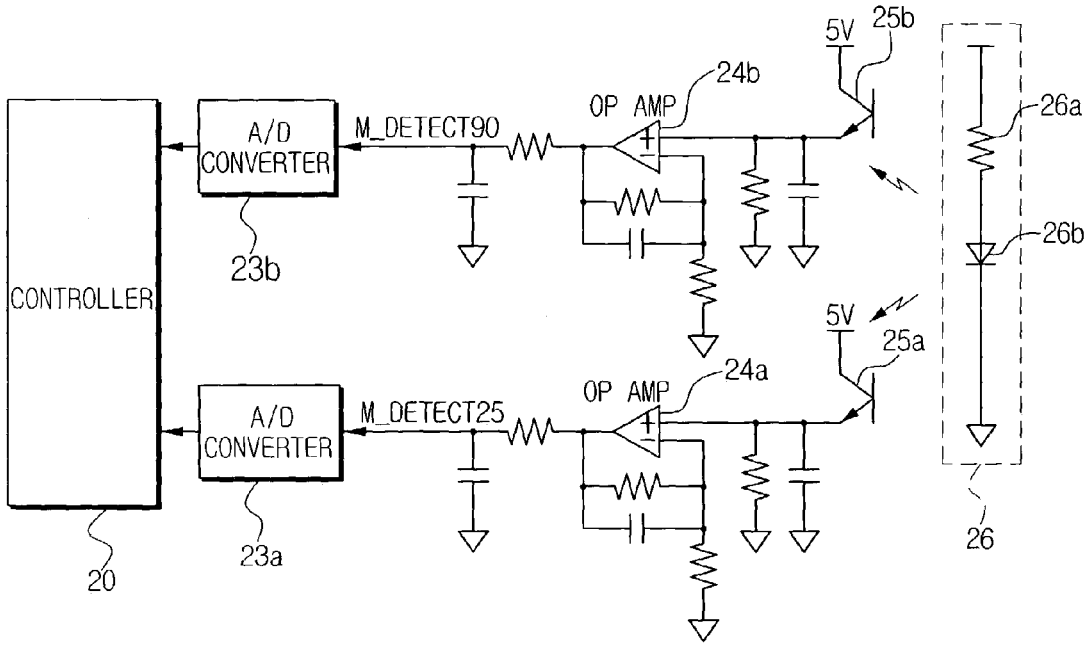
FIG.3 (PRIOR ART)
FIG. 3 is a circuit diagram illustrating a media sensor of the conventional paper feeding apparatus of FIG. 1.
Figure 4:
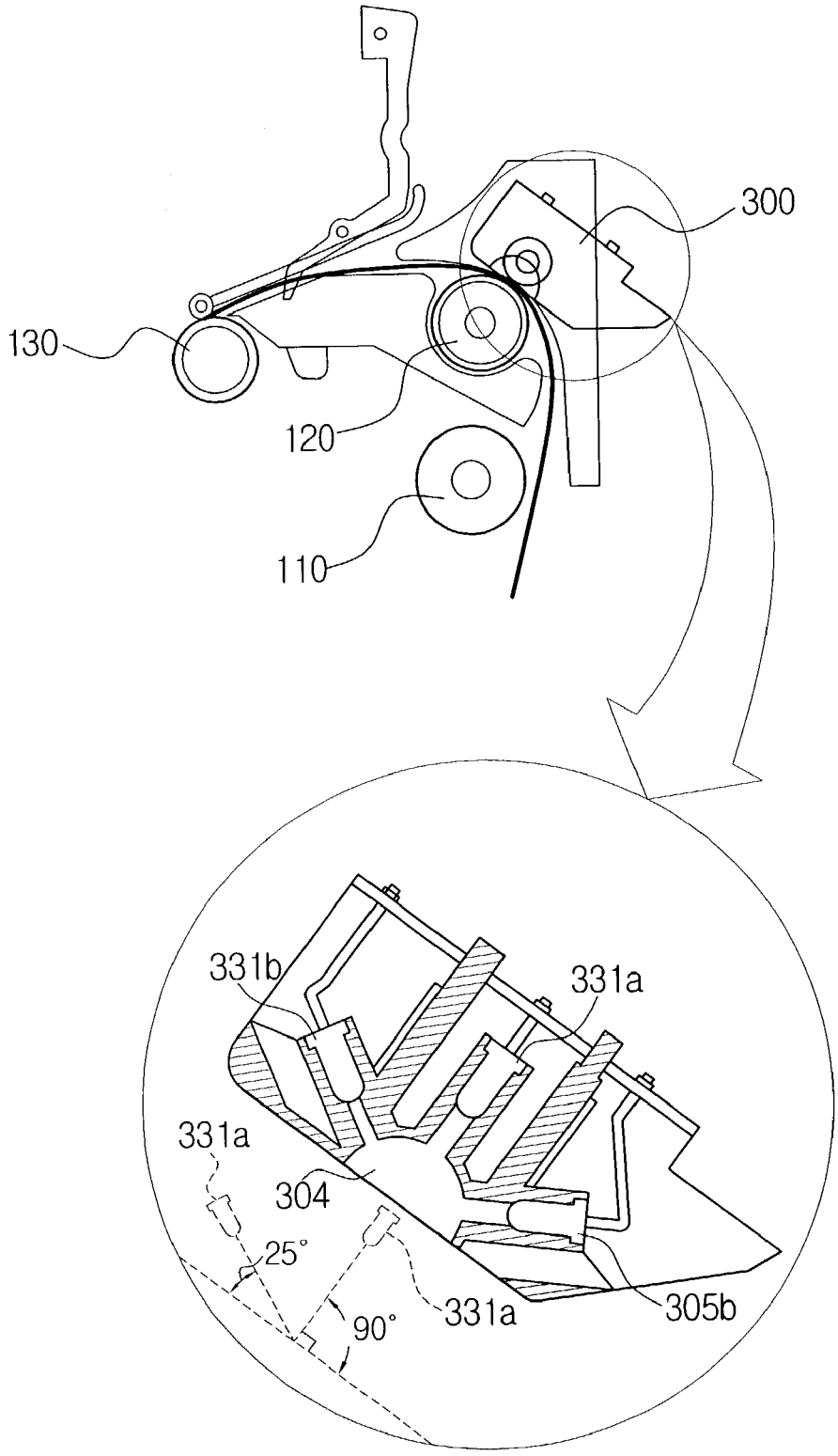
FIG. 4 is a schematic view illustrating a paper feeding apparatus according to the present invention.

FIG. 4 is a schematic view illustrating the construction of a paper feeding apparatus according to an embodiment of the present invention. As shown in FIG. 4, the paper feeding apparatus in the image forming apparatus according to the present invention includes a pick-up roller 110, a driving roller 120, a feeding roller 130, a media sensor 300, and a controller (not shown).

The pick-up roller 110, being rotated by a pick-up motor (not shown), picks up a paper from a paper stack part (not shown) and transfers the paper so that the paper enters a paper transferring path indicated by a bold solid line in FIG. 4. The driving roller 120 is rotated by driving a line feeding roller (not shown), and transfers the picked-up paper along the paper transferring path. The feeding roller 130 is rotated by a line feeding motor, and aligns a paper by rotating backward when the paper reaches the driving roller 120. The feeding roller 130 rotates forward with the completion of the paper type detection so that the paper can be transferred to a printing device (not shown) where printing is performed.

The media sensor 300 is positioned on the paper transferring path, and detects the paper type and whether the paper is picked up.

The media sensor 300 includes a light emitting diode (LED) 305*b* and phototransistors 331*a* and 331*b*. The LED 305*b* emits light to a chamber 304 defined in the media sensor 300, whereas the phototransistors 331*a* and 331*b* receive the reflected light from the paper passing the chamber 304 at different angles, for example at 25° and 90°, with respect to the paper. The phototransistor 331*b*, arranged at 25° with respect to the paper, detects the paper entrance.

Figure 5:
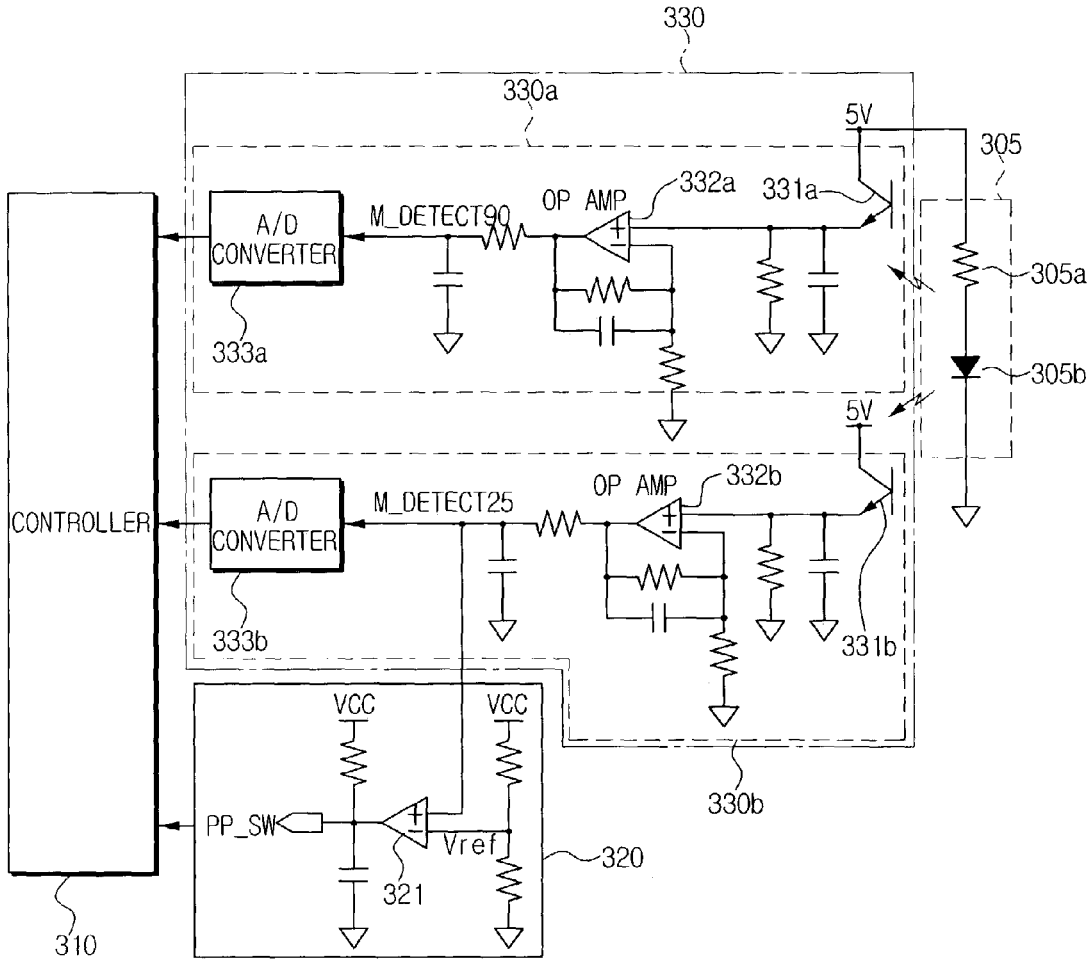
FIG. 5 is a circuit diagram illustrating a media sensor of the paper feeding apparatus of FIG. 4.

FIG. 5 illustrates a circuit for driving the media sensor of FIG. 4 The media sensor driving circuit includes a light emitting unit 305, a light receiving unit 330, a pick-up switch unit 320 and a controller 310. The light receiving unit 330 includes a first light receiving unit 330*a* and a second light receiving unit 330*b*.

The light emitting unit 305 includes a resistor 305*a* connected in series between a power voltage (for example, 5V) and a photo diode 305*b*. The photo diode 305*b* projects light to the chamber 304.

The first and second light receiving units 330*a* and 330*b* of the light receiving unit 330 receive the light from the light emitting unit 305 at different angles,; for example at 90° and 25°. In this case, the phototransistor 331*a* of the first light receiving unit 330*a* is arranged in a perpendicular relation, i.e., at 90° with respect to the paper, while the phototransistor 331*b* of the second light receiving unit 330*b* is arranged at 25° with respect to the paper.

The phototransistor 331*a* at 90° with respect to the paper has almost '0' output when the printing medium is of transparent material, because there is almost no reflection of light. This means the phototransistor 331*a* at 90° can hardly detect whether the transparent paper is picked up or not due to lack of input signal. Accordingly, the pick-up switch unit 320 is connected to the output side of the other phototransistor 331*b* installed at 25°.

The first light receiving unit 330*a* amplifies the voltage according to the light received at the phototransistor 331*a* formed at 90° with respect to the paper passing the chamber 304. The amplified voltage is converted at an analog-todigital (A/D) converter 333*a* into a digital signal and is applied to the controller 310. The second light receiving unit 330*b* amplifies the voltage according to the light received at the phototransistor 331*b* at 25° with respect to the paper passing the chamber 304. The amplified voltage is converted, at an A/D converter 333*b*, into a digital signal and is applied to the controller 310.

The pickup switch unit 320, in response to the voltage value M_DETECT25 output from an operation amplifier 332*b* of the second light receiving unit 330*b*, detects whether the paper enters the chamber 304. The pickup switch unit 320 compares the output voltage M_DETECT25 from the operation amplifier 332*b* with a reference voltage Vref, and when the output voltage M_DETECT25 is higher than the reference voltage Vref, outputs a 'HIGH' signal, i.e., paper entrance determination signal PP_SW, to the controller 310 indicating that the paper has entered the paper transferring path.

The controller 310 controls overall operation of the paper feeding apparatus in accordance with an externally-input command, detect signals M_DETECT90 and M_DETECT25 from the sensor, and programs implemented in the apparatus. With the reception of the paper entrance determination signal PP_SW at the pickup switch unit 320, the controller 310 determines that the paper is picked up and enters the paper transferring path. The controller 310 also computes a ratio of A/D conversion values of the outputs M_DETECT90 and M_DETECT25 of the operation amplifiers 332*a* and 332*b* in accordance with the two phototransistors 331*a* and 331*b*, and determines the paper type in accordance with the computed output ratio and with reference to preset paper types.

Figure 6A:
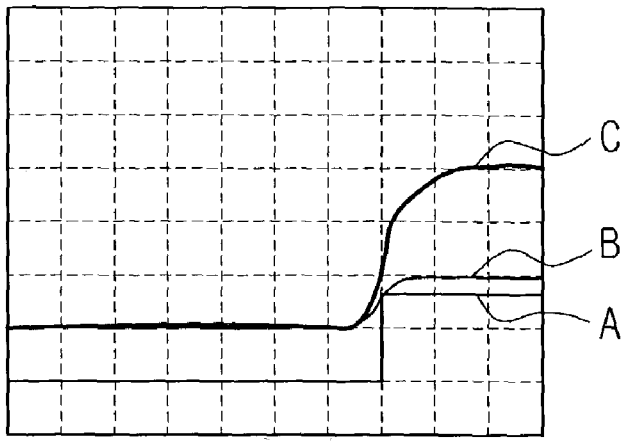
FIGS. 6A and 6B are graphs illustrating outputs of the media sensor shown in FIG. 5.

The output of the media sensor 330 is described below in detail with reference to FIGS. 6A and 6B. FIG. 6A is a graph illustrating the output from the media sensor 300 when a standard paper enters the paper transferring path. The line A represents an output from the pickup switch unit 320, the curved line B represents an output from the phototransistor 331*b* at 25° and the curved line C represents an output from the phototransistor 331 a at 90°. As shown in FIG. 6A, with the entrance of the paper, the phototransistor 331*b* is turned on, causing a voltage higher than the reference voltage Vref to be input to the comparator 321, and the paper entrance determination signal PP_SW to be applied subsequently to the controller 310.

Different outputs, as represented by the lines B and C of FIG. 6A, are input to the controller 310 from the two phototransistors 331*a* and 331*b* at respective angles. The controller 310 computes a ratio of the outputs B and C, and accordingly, determines the paper type.

Figure 6B:
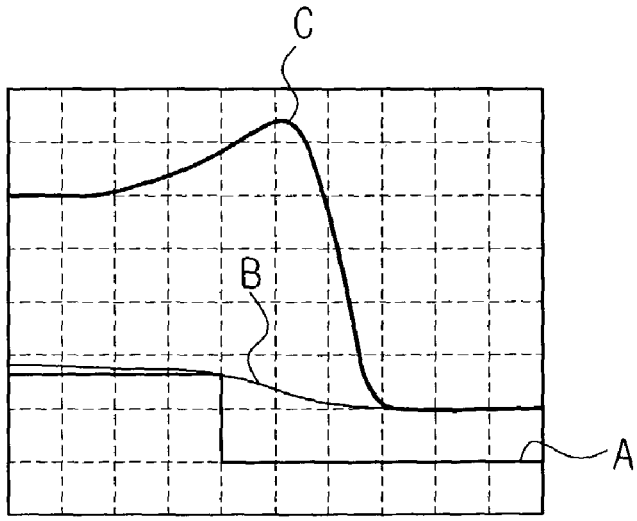

FIG. 6B is a graph illustrating outputs from the media sensor 300 in the procedure wherein the paper is being separated from the media sensor 300. As a description of FIG. 6B is the same as that of FIG. 6A, a detailed explanation thereof is omitted.

Figure 7:
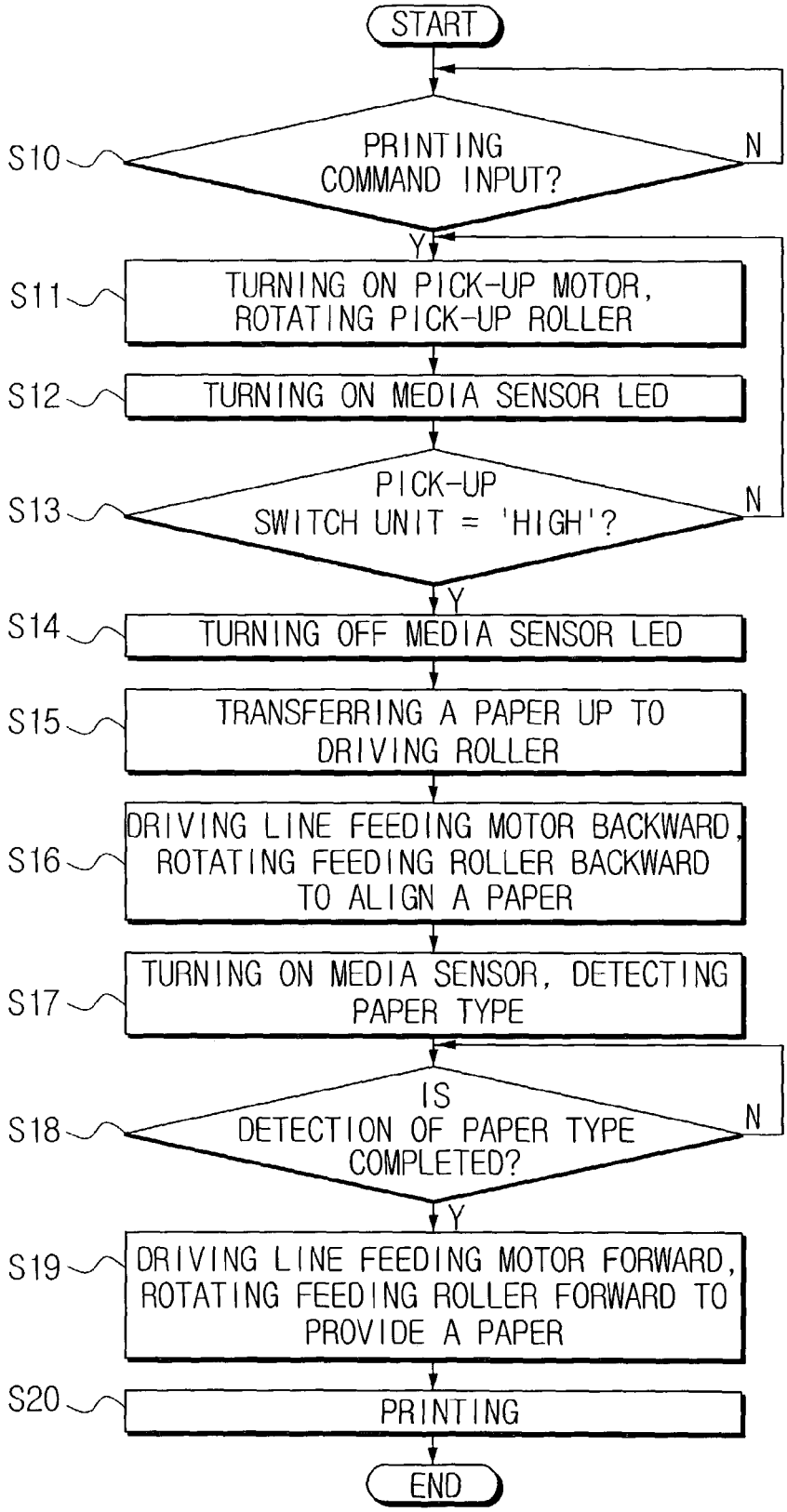
FIG. 7 is a flowchart illustrating a controlling method for the paper feeding apparatus shown in FIG. 4.

A method to control the paper feeding apparatus in the image forming apparatus according to the present invention is described with reference to FIG. 7 below. With a reception of a printing command at the controller 310 (S10), the pick-up motor is driven (S11), and the LED 305*b* of the media sensor 300 is turned on (S12). As the pick-up roller 110 is rotated by the pickup roller 110, a paper is picked up from the paper stack part and entered into the paper transferring path.

As the paper enters the paper transferring path, light from the LED 305*b* of the media sensor 300 is reflected from the paper and incident in the phototransistor 331*b* of the light receiving unit. With the reflected light being incident thereon, the phototransistor 331*b* is turned on and outputs a signal. The output signal from the phototransistor 331*b* is amplified by the amplifier 332*b*, then is input to the comparator 321 of the pickup switch unit 320. The pickup switch unit 320 is connected to the output side of the phototransistor 331*b* installed at the position of 25° with respect to a paper. If the phototransistor 331*b* is turned on, a voltage higher than the reference voltage Vref is applied to the comparator 321, and the pick-up switch unit 320 outputs the paper entrance determination signal.

If the paper entrance determination signal PP_SW is received in the controller 310 (S13), the controller 310 determines that a paper enters the paper transferring path, and thus turns off the media sensor 300 (S14). After that, when the paper is transferred to the driving roller 120, the feeding roller 130 is rotated backward, so that the paper is aligned (S15 and S16). If the feeding roller 130 is rotated backward, a paper is aligned and comes into contact with the media sensor 300, turning on the LED 305*b* of the media sensor 300.

The controller 310 detects a paper type by computing a ratio of the output signals from the phototransistors 331*a* and 331*b* installed at different angles respectively with respect to a paper (S17). The paper types according to the output signals are determined in advance experimentally, and are stored in a database. If detection of the paper type is completed, the line feeding motor is driven forward to rotate the feeding roller 130 forward, and printing is performed depending on the paper type (S19 and S20).

According to the present invention, whether a paper enters the paper transferring path is detected by the media sensor for sensing the paper type. Therefore, with a simple construction, detection of the paper type and determination of whether a paper is picked up are determined without requiring additional parts, so that improvement is accomplished in the aspects of mechanical construction and manufacturing costs.

embodiments thereof, it will be understood by those skilled in the art that various changes in form and details may be made therein without departing from the spirit and scope of the invention as defined by the appended claims. The foregoing embodiments and advantages are merely exemplary and are not to be construed as limiting the present invention. The present teaching can be readily to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function, including not only structural equivalents, but also equivalent structures.] Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An apparatus to feed a paper in an image forming apparatus comprising:

a pick-up roller rotated by a pick-up motor, to pick up a paper;

a media sensor having a light emitting unit positioned on a paper transferring path, to emit light onto a paper moved forward by the pick-up roller;

at least one light receiving unit installed at a predetermined angle with respect to the paper, to receive light reflected from the paper, the paper being illuminated by the light from the light emitting unit and moved forward along the paper transferring path;

a pick-up switch unit to output a paper entrance determination signal by comparing an output signal from the light receiving unit with a predetermined reference signal; and a controller to determine whether a paper is provided on a basis of the paper entrance determination signal input from the pick-up switch unit, and to determine a paper type using an output signal from the light receiving unit.

2. The apparatus according to claim 1, further comprising an A/D (Analog/Digital) converter to convert the output signal from the light receiving unit into a digital signal and applying the same to the controller.

3. The apparatus according to claim 1, wherein the light receiving unit comprises two phototransistors installed at different angles with respect to a paper provided to the paper transferring path.

4. The apparatus according to claim 3, wherein the controller determines a paper type according to a ratio of output values from the two phototransistors.

5. A method of feeding a paper in an image forming apparatus, comprising:

if a printing command is received, driving a pick-up motor, and simultaneously turning on a light emitting unit;

if a light receiving unit is turned on and a paper entrance determination signal is output from a pick-up switching part, determining that paper is provided and turning off the light emitting unit;

if a pick-up roller is rotated and a paper is transferred up to a driving roller, aligning the paper;

if the paper is aligned, detecting a paper type; and if detection of the paper type is completed, feeding a paper and performing printing depending on the detected paper type.

6. The method according to claim 5, wherein the detecting of the paper type comprises receiving light from two different angles with respect to the paper.

7. The method according to claim 5, wherein the detecting of the paper type includes sequentially turning on the light emitting unit, computing a ratio of output values received from two transistors, and determining a paper type among set paper types depending on the ratio of the output values.

8. An apparatus to feed a paper in an image forming apparatus comprising:

a media sensor comprising;

at least one light receiving unit to receive light reflected off of a piece of paper; and a controller to determine whether the piece of paper is provided on a basis of a first signal from the at least one light receiving unit, and to determine a paper type using a second signal from the at least one light receiving unit.

9. The apparatus according to claim 8, further comprising an analog/digital converter to convert at least one of the first or second signals into a digital signal and apply the same to the controller.

* * * * *